United States Patent [19]

Kuechler

[11] Patent Number: 4,506,655

[45] Date of Patent: Mar. 26, 1985

[54] COMPACT DOUBLE FAN APPARATUS AND METHOD WITH GREASE-SEPARATING CAPABILITIES

[76] Inventor: Irvin R. Kuechler, 172 E. 27th St., San Bernardino, Calif. 92402

[21] Appl. No.: 578,598

[22] Filed: Feb. 10, 1984

Related U.S. Application Data

[63] Continuation of Ser. No. 231,136, Feb. 3, 1981, abandoned.

[51] Int. Cl.[3] ..... A47J 36/38

[52] U.S. Cl. ..... 126/299 D; 55/406; 55/DIG. 36; 98/62; 98/33.1

[58] Field of Search ..... 55/406, 465, DIG. 36; 98/33 R, 43 C, 62; 126/299 R, 299 D, 299 F

[56] References Cited

U.S. PATENT DOCUMENTS

| | | | |
|---|---|---|---|
| 2,889,007 | 6/1959 | Lunde | 126/299 D X |
| 3,122,307 | 2/1964 | Wasson et al. . | |
| 3,393,497 | 7/1960 | Donnelly | 126/299 D X |
| 3,411,428 | 11/1968 | Ahlrich | 98/115 |
| 3,487,767 | 1/1970 | Kristiansen | 98/33 |
| 3,513,766 | 5/1970 | Ahlrich | 98/115 |
| 3,557,681 | 1/1971 | Kristiansen | 98/33 |
| 3,570,386 | 3/1971 | Baumann | 98/33 |
| 3,664,255 | 5/1972 | Kuechler | 98/115 |
| 3,722,396 | 3/1973 | Peill et al. | 98/33 |
| 3,750,557 | 8/1973 | Peill et al. | 98/33 |
| 3,865,022 | 2/1975 | Ahlrich | 126/299 D |
| 4,043,319 | 8/1977 | Jensen | 126/299 D |
| 4,130,111 | 12/1978 | Ristic | 126/299 |

FOREIGN PATENT DOCUMENTS

| | | | |
|---|---|---|---|
| 53528 | 8/1911 | Switzerland | 98/33 R |
| 1246935 | 9/1971 | United Kingdom | 98/33 R |

*Primary Examiner*—Harold Joyce

[57] ABSTRACT

A double-fan apparatus for use in combination with an exhaust hood adapted to be mounted over a cooking appliance in a kitchen. The fan has an upper impeller section and a lower impeller section each of which is a centrifugal impeller. There is a conduit to pass grease-laden fumes upwardly from the exhaust hood to the lower impeller section, and a conduit to conduct makeup air downwardly from the double fan to the hood. The double fan includes relationships by which the makeup air passes generally horizontally from the ambient atmosphere to the upper impeller section, then flows generally horizontally from the upper impeller section to the peripheral regions of the double fan, and then flows downwardly to the conduit connected to the hood. A grease trap is built into the double fan to prevent upward flow of substantial amounts of grease.

20 Claims, 6 Drawing Figures

80
82
144
74
78
84
86
52
126
112
114
116
46
70
56
76
128
50
110
108
104
54
44
34
102
102a
28a
48
20
134
30
118
138
136
134
60a
137
60
140
32
92
88
24
88a
58a
28
90
62
28b
94
58
36
100
48
98
96
98
58b
66
64
42
40
32a
38

COMPACT DOUBLE FAN APPARATUS AND METHOD WITH GREASE-SEPARATING CAPABILITIES

CROSS REFERENCE TO RELATED APPLICATION

This application is a continuation of my pending application Ser. No. 231,136, filed Feb. 3, 1981, now abandoned, for Compact Double Fan Apparatus and Method With Grease-Separating Capabilities.

DETAILED DESCRIPTION OF THE DRAWINGS

Figure 1:
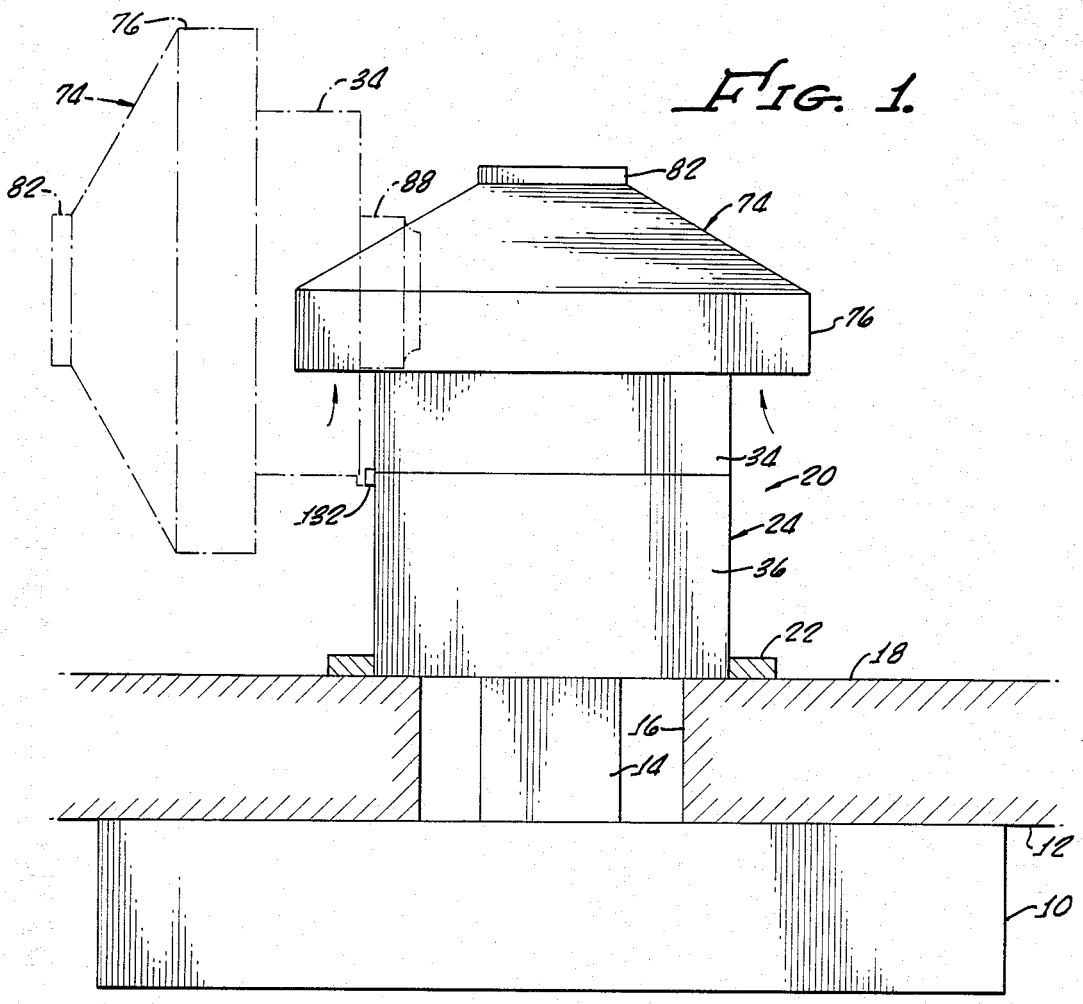
FIG. 1 is a side elevational view of a makeup air-type kitchen exhaust hood to which is connected a rooftop supply and exhaust air fan unit embodying principles of the present invention.

Illustrated in FIG. 1 is an exhaust hood 10 of the type in which exhaust air and untempered makeup air are simultaneously withdrawn from and supplied to the hood. The representative hood 10 is secured to a kitchen ceiling 12 and is positioned above one or more cooking appliances (not shown) to upwardly exhaust the grease-laden fumes generated thereby.

To simultaneously exhaust the cooking fumes through the hood, and to supply makeup air to replace a predetermined large portion of the volume of air withdrawn from the hood, concentric exhaust and supply ducts 14, 16 are used. The concentric ducts are connected to a central portion of the upper end of the hood and are extended upwardly through an opening (not shown) formed in the roof 18 above the ceiling 12. The exhaust duct 14 is positioned within the makeup air duct 16 and is used to withdraw cooking fumes through a central portion of the hood, while the makeup air duct is used to transfer downwardly flowing fresh air to the perimeter of the hood (via baffle means, not shown, within the hood) where it is discharged.

The problem of making suitable exhaust and supply fan and duct connections to the concentric ducts 14, 16 to achieve the necessary counterflowing streams of exhaust and makeup air is a well-known one. The conventional method of making such connections to the concentric ducts is to field-fabricate separate supply and exhaust systems. This typically entails mounting separate supply and exhaust fans on the roof and then extending a separate duct from each of the fans and connecting it to one of the concentric hood ducts. Such a laborious and time-consuming task, since one of the field-installed roof ducts must be built around the other duct (and then extended in different directions to their respective roof fans) to isolate the separate air streams. Additionally, the separate ducts must be carefully fabricated at their juncture to preclude not only air leakage, but the entry of rain into the concentric hood ducts.

The conventional construction technique, because of the high cost of field labor, has proven to be a major expense in the construction of kitchen ventilation systems. The task is rendered additionally difficult on a kitchen remodeling project (i.e., where the makeup air-type exhaust hood is added or used to replace an existing hood) where roof space directly above the new hood is limited because of the presence of existing rooftop equipment, such as air handling units, exhaust fans or the like.

This long-standing problem is inexpensively solved by the present invention which provides a compact supply and exhaust air fan unit 20 which maybe entirely factory fabricated, shipped to the job site, mounted on a roof curb 22 formed around the concentric duct roof opening, and quickly connected to the upper end of the concentric ducts 14, 16.

Figure 2:
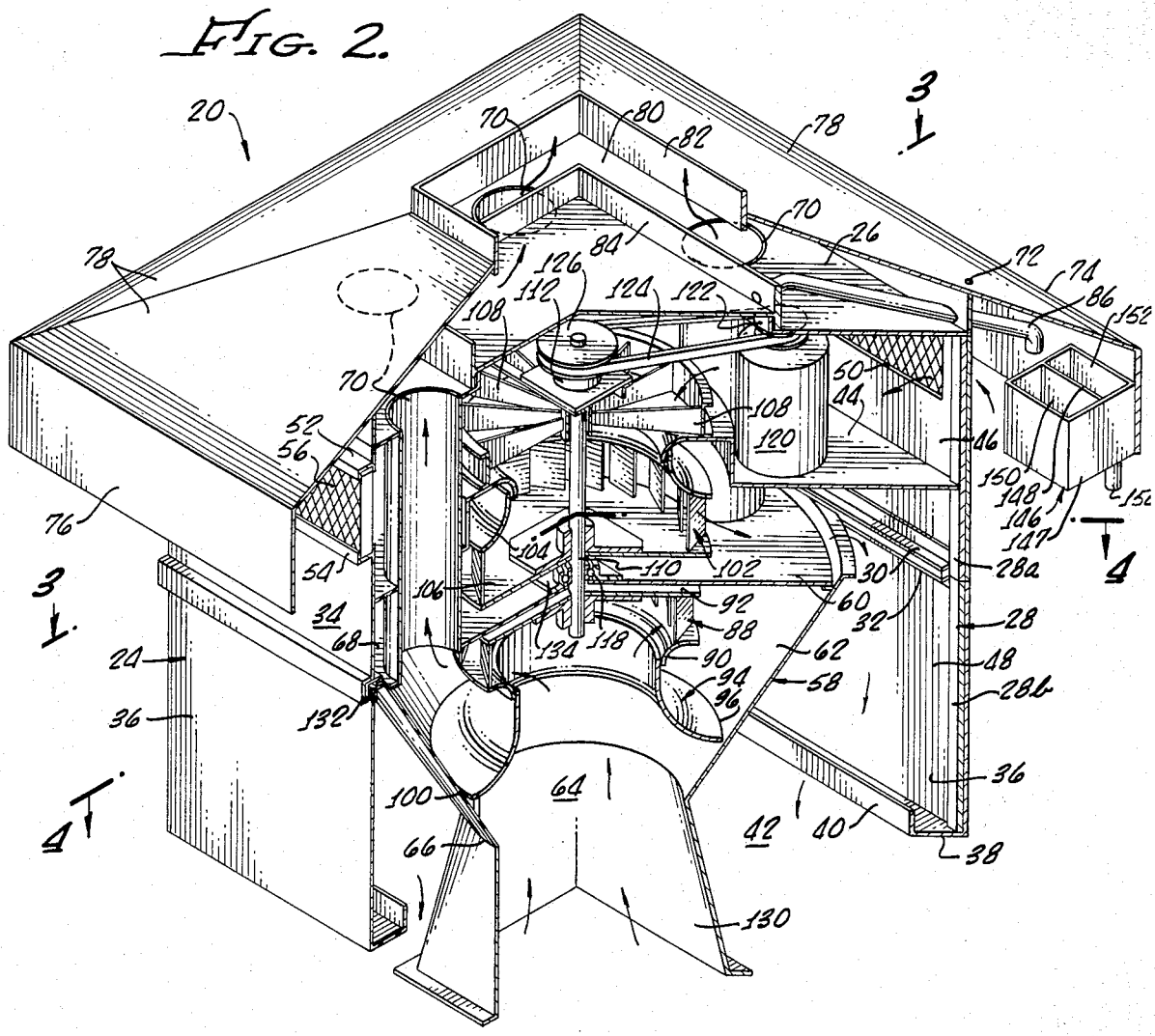
FIG. 2 is an enlarged, partially cut away perspective view of the fan unit taken on line 2—2 of FIG. 4.
Figure 5:
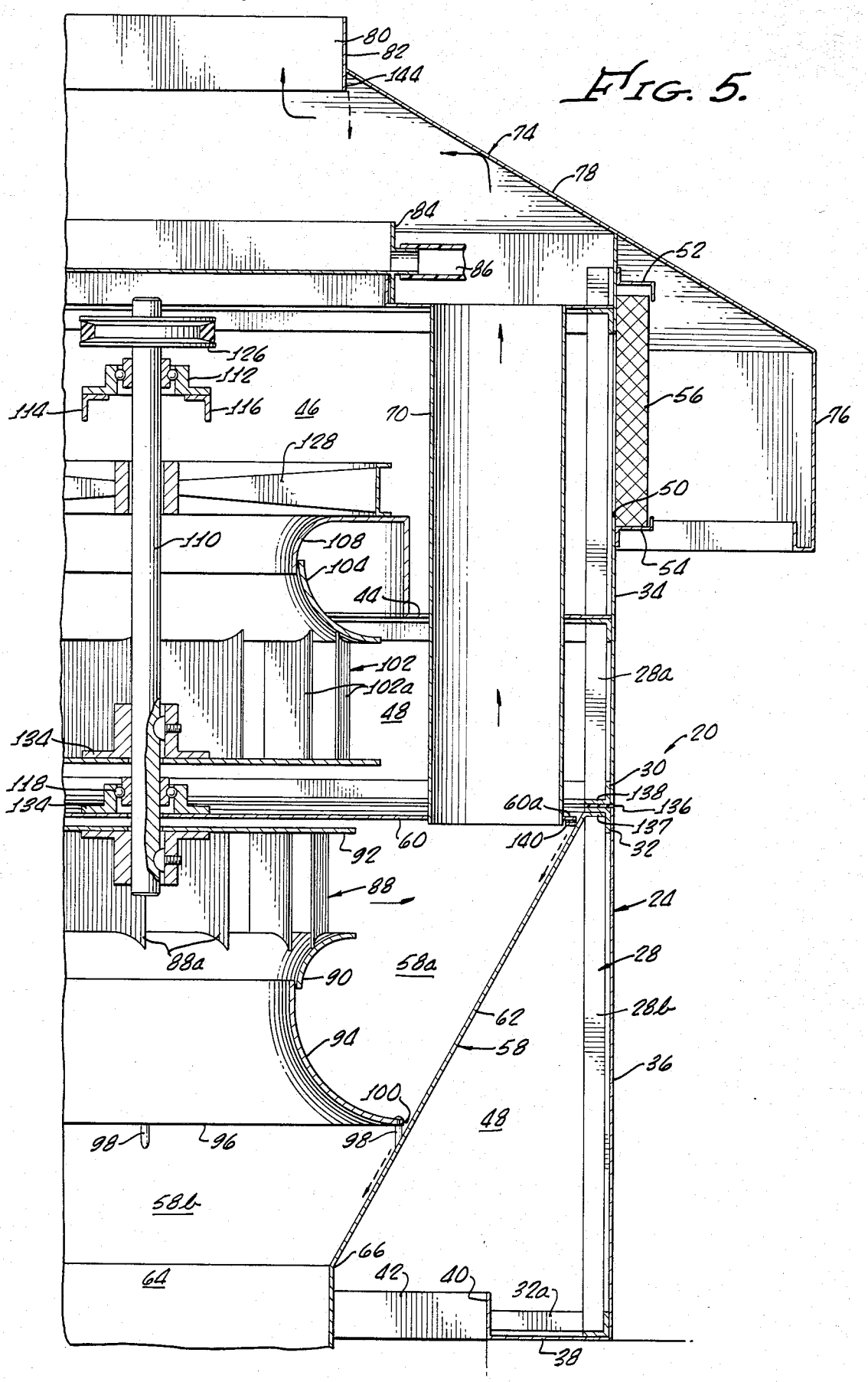
FIG. 5 is an enlarged, fragmentary cross-sectional view through the right side of the fan unit.

Referring to FIGS. 2 and 5, the fan unit 20 includes a sheet metal outer or supply air casing 24 having a rectangular cross-section, an upper end wall 26, and four side walls extending downwardly from the upper end wall. The side walls extend horizontally between four upwardly extending corner support members or channels 28 which are cross-braced by horizontally extending, adjacent support members 30, 32 extending between each pair of the vertical support members 28 at approximately the midpoint of their lengths. Additional horizontally extending cross-bracing channels **30*a*, 32*a* extend respectively around the upper and lower corners of the casing 24. For reasons described below, each of the vertically extending support members 28 is formed in an upper section 28*a* connected to the horizontal support member 30 and a lower portion 28*b* connected to the horizontal support member 32**.

The four downwardly extending side walls of the outer casing 24 each comprises an upper section 34 (which is also a removable access panel) extending horizontally between a pair of vertical support member portions **28*a*, and vertically between the upper end wall 26 and a horizontally extending support member 30, and a lower access panel portion 36 which is removably connected to a pair of the lower vertical support member portions 28*b***.

At the lower end of the outer casing 24 is a support flange 38 which extends horizontally inwardly around the entire perimeter of such lower end. At the inner edge of the support flange 38 is an upturned duct attachment flange 40 which also extends around the perimeter of the lower end of the outer casing 24, and further defines a discharge opening 42 from the interior thereof.

Extending horizontally across the interior of the outer casing 24 between the upper end wall 26 and the horizontal support member 30 is a sheet metal baffle 44 which divides the interior of the outer casing 24 into a makeup air intake chamber 46 above the baffle 44, and a makeup air discharge chamber 48 below the baffle.

An elongated rectangular fresh air inlet opening 50 is formed through each of the upper side wall portions 34 adjacent the upper end wall 26. Each of the inlet openings 50 extends longitudinally across substantially the entire horizontal extent of the side wall portion through which it is formed. By means of suitable upper and lower externally projecting mounting brackets 52, 54 an inlet air filter 56 is mounted at each of the inlet openings 50.

Mounted coaxially within the air discharge chamber 48 of the outer casing 24 is an inner air handling casing 58. The inner casing 58 has a truncated conical shape, a circular upper end wall 60 positioned below the baffle 44, and a side wall portion 62 that slopes downwardly and laterally inwardly from the upper end wall 60, defining at its lower end a circular air inlet opening 64 having a smaller diameter than that of the circular upper end wall 60. Extending horizontally outwardly from the side wall portion 62 around the perimeter of the inlet opening 64 is a duct attachment flange 66. The duct attachment flange is positioned upwardly and laterally inwardly of the duct attachment flange 40, the two flanges thereby defining a discharge air opening which circumscribes the air inlet opening 64.

Figure 4:
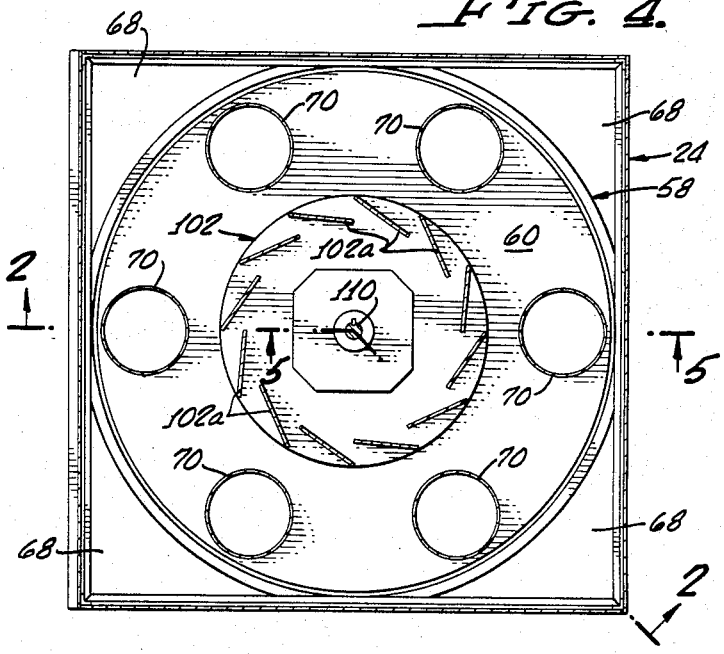
FIG. 4 is a cross-sectional view through the fan unit taken along line 4—4 of FIG. 2.

The circular upper end wall 60 of the inner casing extends completely across the discharge chamber 48 between opposite pairs of the outer casing side walls, and defines with such sidewalls four air passages 68 (FIG. 4) from the portion of the air discharge chamber 48 above the upper end wall 60 to the portion of the discharge air chamber below it. Each of the openings 68 is positioned at an inner, vertically extending corner of the outer housing 24 as best seen in FIG. 4. The corner openings 68 define a portion of a vertically extending air passage, within the outer casing, which circumscribes the inner casing.

Six cylindrical branch air discharge ducts 70 are each connected at one end to the upper end wall 60 of the inner casing, and are spaced circumferentially around the upper end wall slightly inwardly of its periphery as indicated in FIG. 4. Each of the cylindrical ducts 70 extends upwardly from the upper end wall 60 through the baffle 44 and outwardly through suitable openings formed in the upper end wall 26 of the outer casing 24. As will be seen, these cylindrical ducts define branch air discharge passages from the interior of the inner casing 58 through the outer casing upper end wall 26.

By exhaust and supply fan means described below, exhaust air (from the exhaust duct 14 after it is connected to the unit 20 as subsequently described) is drawn upwardly into the inner housing inlet 64, is forced laterally outwardly within the inner housing 58 and then is forced upwardly through the discharge tubes 70 through the upper end wall 26 of the outer casing 24. Simultaneously, outside air is drawn laterally inwardly through the filters 56 and the outer casing inlet openings 50 to a horizontally central portion of the air intake chamber 46, and then is forced downwardly into the air discharge chamber 48, laterally outwardly to the downward corner air passages 68, and then downwardly through the passages 68 and out the portion of the discharge opening 42 circumscribing the inlet opening 64 of the inner casing 58.

Removably secured to the upper ends of the vertical support angle portions 28*a* by suitable fasteners 72 is a sheet metal rain hood 74 (FIGS. 2 and 5). The rain hood has a rectangular downturned flange portion 76, each of whose four sides is spaced laterally outwardly of and extends downwardly in front of one of the filters 56 to prevent the entry of rain therethrough. From the upper end of the flange 76 extend four inwardly and upwardly sloping walls 78 which meet at a horizontally central portion of the rain hood and define a rectangular upper end discharge opening 80. An upturned flange 82 is formed or otherwise secured to the rain hood around the entire perimeter of the discharge opening 80.

Air drawn inwardly through the filters 56 is first drawn upwardly within the confines of the downturned hood flange 76, and air exiting the discharge tube 70 is forced upwardly through the hood discharge opening 80. Rain entering the hood discharge opening 80 is caught in a drain pan 84 positioned below the discharge opening 80 and secured to the upper end wall 26 of the outer casing 24. Rain entering the drain pan is drained therefrom through a tube 86 and discharged as described below.

The fan means mentioned above include a centrifugal impeller wheel 88 (FIGS. 2 and 5) positioned coaxially within the inner casing 58 and having blades 88*a*. The impeller 88 has a downwardly facing conical inlet flange 90, and a side closure plate 92, opposite the inlet flange 90, positioned just below the upper end wall 60 of the inner casing 58. The inlet flange 90 rotatably receives the circular, reduced diameter upper discharge end of an air inlet cone 94 whose larger diameter lower inlet end 96 faces the inlet opening 64 of the inner casing 58. The inlet cone 94 is supported within the inner casing 58 by a plurality of small support posts 98 connected to and extending upwardly from the interior of the inner casing sidewall portion 62.

For reasons described below, a small gap 100 (FIG. 5) is left between the periphery of the lower end 96 of the inlet cone 94 and the interior of the upwardly sloping side wall portion 62 of the inner casing. The inlet cone 94 divides the interior of the inner casing into an upper discharge chamber 58*a* above the cone 94, and an air inlet chamber 58*b* below it.

The fan means of the unit 20 also include a centrifugal impeller wheel 102 (having blades 102*a*) which is coaxial with the impeller wheel 88 and is positioned between the baffle 44 and the upper end wall 60 of the inner casing. Impeller 102 has a diameter slightly larger than that of impeller 88, and has an upwardly extending conical inlet flange 104 and a side closure plate 106 opposite the flange 104. An inlet cone 108 is formed from or otherwise secured to a central portion of the baffle plate 44 and has a downwardly facing reduced diameter discharge end portion which is rotatably received within the reduced diameter upper end of the impeller inlet flange 104. Air entering the air intake chamber 46 is thus directed into the inlet cone 108 and into the impeller wheel 102 through its conical inlet flange 104.

Figure 3:
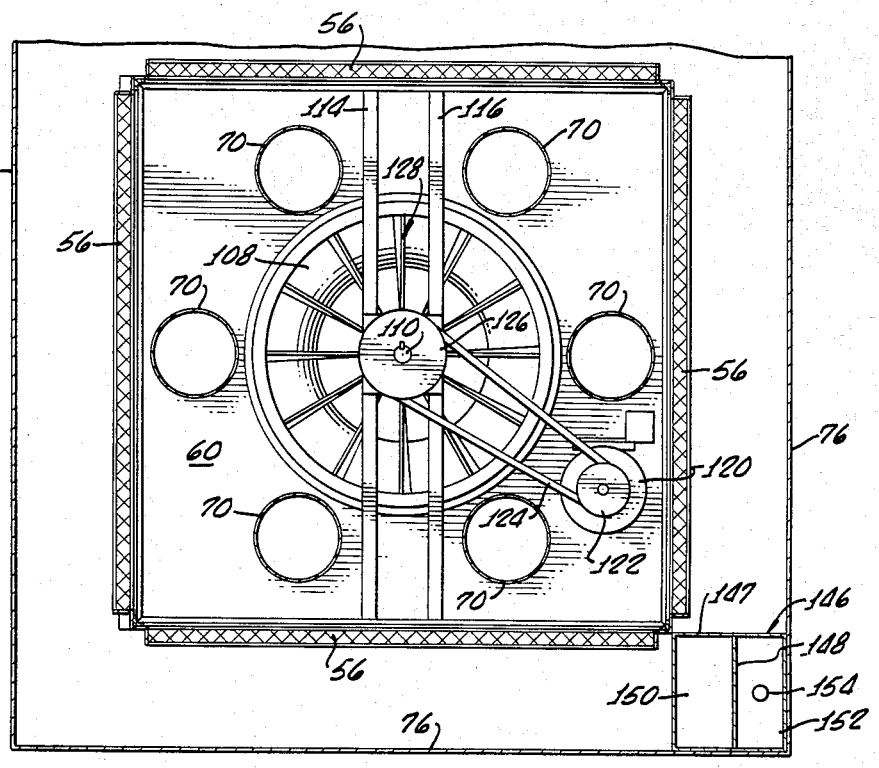
FIG. 3 is a cross-sectional view taken horizontally through the upper part of the unit 3—3 of FIG. 2.

The exhaust and supply impellers 88, 102 are mounted for conjoint rotation on a shaft 110 which extends vertically from just below the impeller side closure plate 92 to adjacent the upper end wall 26 of the outer casing. The shaft is rotatably mounted in an upper bearing 112 which is carried by two support angles 114, 116 (FIGS. 3 and 5) secured to and extending between a pair of opposite upper side wall portions 34 of the outer casing 24 below the upper end wall 26, and a second bearing 118 fixed to the upper end wall 60 of the inner casing.

It should be noted that the centrifugal impellers 88, 102 are each of standard construction and thus require no special fabrication or connection to the shaft 110.

Mounted within the air intake chamber 46 is a single electric motor 120 (FIGS. 2 and 3) having an adjustable driving pulley 122 fixed to its drive shaft. The single motor 120 is used to rotate the shaft 110, and thus the dual impellers 88, 102, by means of a drive belt 124 interconnecting the driving pulley 122 with a driven pulley 126 fixedly secured to the upper end of the shaft 110. For purposes of adjusting the quantity of air flowing into the impeller 102, an adjustable inlet vane damper 128 is secured to the entrance to the inlet cone 108.

When the motor 120 is energized, the shaft 110 and the impellers 88, 102 are rotated in the same direction (for example, clockwise as indicated in FIG. 4). Each of the impellers 88, 102 is preferably of the backwardly inclined blade type relative to the direction of the shaft rotation.

Exhaust air is drawn upwardly through the inner casing inlet opening 64, through the inlet cone 94 and into the exhaust impeller 88. The exhaust air is then forced laterally outwardly through the impeller 88 around its entire periphery into the discharge chamber 58*a* of the inner casing. The air exiting the impeller 88 is then forced upwardly through the exhaust discharge tubes 70 to above the upper end wall 26 of the outer casing, and thence upwardly through the rain hood discharge opening 80.

Simultaneously, fresh air (i.e., "outside" air from above the roof) is drawn upwardly into the peripheral space between the downturned hood flange 76 and the exterior of the outer casing 24, and is drawn inwardly through the filters 56 and passes laterally into the air intake chamber 46. The fresh air entering the intake chamber 46 then passes downwardly through the inlet vane damper 128, through the inlet cone 108 and then through the inlet flange 104 and into the upper impeller 102. The fresh air (or makeup air) is then forced laterally outwardly through the impeller 102 around its entire periphery. Finally, the makeup air is forced downwardly through the discharge openings 68 located at the corners of the outer casing 24 and outwardly through the lower open end of the outer casing around the periphery of the inlet opening 64 of the inner casing. It can be seen at this point that the entering exhaust air stream and the leaving makeup air stream are compatible in arrangement with the exhaust air and makeup air patterns required by the concentric exhaust and supply ducts 14, 16. More specifically, exhaust air entering the unit 20 in a central stream is circumscribed by a stream of makeup air being discharged from the unit in the opposite direction.

The quantities of exhaust air and makeup air flowing in opposite directions through the fan unit or air handling unit 20 may each be adjusted by means of the adjustable driving pulley 122 and the inlet vane damper 108. For example, the air handling capability of each of the impellers 88, 102 may be simultaneously increased or decreased by adjusting the driving pulley 122. Then, the quantity of makeup air delivered to the hood can be adjusted relative to the air quantity exhausted therefrom by adjusting the inlet vane damper 108. The vane damper may be adjusted manually, or by automatic controls (not shown).

The fan unit 20, which may be assembled entirely in a shop or factory at labor rates substantially lower than field labor rates, is easily and quickly connected to the concentric exhaust and supply ducts 14, 16. The only field labor required is the fabrication of the roof curb 22 (FIG. 1), the mounting of the unit 20 on top of the curb, and the attachment of the exhaust and supply ducts, respectively, to the duct attachment flanges 66 and 40. Once the unit is mounted on and secured to roof curb 22, such duct connections are easily made (for example, by welding) by removing one or more of the side wall access panels 36 to gain access to the weld points. As previously mentioned, the attachment flange 66 is positioned above the attachment flange 40. To accommodate this height differential, a square-to-round transition duct section 130 (which may also be fabricated in the shop or factory) is interconnected between the attachment flange 56 and the upper end of the exhaust duct 14.

The described fan apparatus and its simple method of installation provides a substantial reduction in both assembly costs and installation costs compared to the conventional on-site fabrication of separate exhaust and supply systems. In addition to this advantage, and despite the great compactness of the fan unit 20, the impellers 88, 102 and the entire interior of the inner air handling casing 58 are rendered quickly and easily accessible by a "swing out" construction feature of the unit which will now be described.

As previously mentioned, the corner support members 28 each comprise separate upper and lower sections 28*a*, 28*b*. This divides the outer casing 24 into separable upper and lower sections, the upper section including and extending upwardly from the horizontal support channels 30, and the lower section including and extending downwardly from the horizontal support channels 32. The upper and lower sections of the casing 24 are connected by a hinge 132 which extends along substantially the entire width of one of the side walls of the outer casing.

This hinged connection between the upper and lower sections of the outer casing 24 permits the upper section to be pivoted outwardly at the hinge as indicated in phantom in FIG. 1. Such outward pivoting of the upper casing section (and the rain hood 74 connected to it) also pivots outwardly the motor 120, the shaft 110, the impellers 88, 102, and the upper end wall 60 of the inner casing 58, permitting access to the impellers 88, 102 and the interior of the inner casing 58.

To allow this outward pivoting of the upper section of the fan unit, the upper end wall 60 is not permanently secured to the upper end of the casing side wall portion 62. Instead, the upper end wall 60 is separate from the balance of the inner casing 58 and is connected to an outwardly extending plate portion 134 of the bearing 118 so that the end wall 60 is also swung outwardly when the upper section of the fan unit is swung out for access.

An outer peripheral portion of the end wall 60 normally tests upon a seal 136 (FIG. 5) secured to a horizontally extending flange 137 formed around the periphery of the upper end of the side wall portion 62. The end wall 60 is removably secured to the flange 137, and the interposed seal 136, by means of fasteners such as screws 138 which are accessible through the access panels 36. These screws or other fasteners prevent the outward pivoting of the upper unit section until desired. Access to the motor 120, the inlet vane damper 108, and the pulleys 122, 126 is provided through the side wall inlet openings 50 and/or the removable elements 34.

Grease Separation

Despite the fact that kitchen exhaust hoods, such as the hood 10, are typically provided with grease filters, grease troughs and other means for removing grease from the exhaust air stream before it reaches the exhaust fan, one of the major problems in conventional cooking exhaust systems is the grease which evades capture by these filters, etc., and is thrown out onto the roof by the exhaust fan, creating, in time, a potential fire hazard.

The fan unit 20 solves this problem, without the use of additional grease filters, by providing two additional stages of grease separation and removal within the unit (the first grease removal "stage" being the grease filters, etc., within the hood 10 itself). As will be seen, such additional grease removal is accomplished by the exhaust air flow pattern previously described, the impellers, the sloping wall portions of the inner casing and the rain hood, lip or corner means associated with such wall portions, and grease draining means.

Referring to FIGS. 2 and 5, the first additional grease separation and removal stage occurs within the inner casing 58. Grease-carrying exhaust air drawn into the exhaust impeller 88 through the inlet cone 94, and thrown outwardly through the impeller around its entire periphery into the discharge chamber 58, impinges upon the inner surface, of the upwardly sloping inner casing side wall portion 62, depositing grease on such inner surface. Therefore, the exhaust air is forced upwardly through the branch discharge tubes 70, and a substantial portion of any grease in the air is separated from the exhaust air stream.

Figure 6:
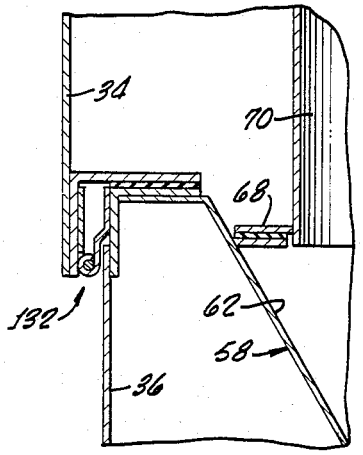
FIG. 6 is a greatly enlarged view of only the left central portion of FIG. 2.

The separated grease is trapped adjacent the lower end of each of the tubes 70 in the circumferentially extending corner 140 at the juncture of the upper end plate 60 and the sloping side wall portion 62. The trapping is accomplished by an outer peripheral portion 60*a* (FIGS. 5 and 6) of the upper end wall 60, outwardly adjacent each of the tubes, which functions as lip means. The lips are adjacent the juncture of the tubes 70 and the inner casing 58, and preclude entry of the separated grease into the tubes.

The grease trapped in the corner 140, which extends around the entire upper end of the inner housing, then drains downwardly along the inner surface of the sloping side wall 62, as indicated by the dashed arrows within the inner casing in FIG. 5. The small circumferential gap 100 between the lower end 96 of the inlet cone 94 and the inner surface of the casing side wall 62 allows the downwardly flowing grease to flow past the inlet cone 94 and then into the exhaust duct 14 where it may be cleaned or otherwise removed by the grease-removing means within the hood. Such downward flow of the separated grease past the inlet cone 94 is aided by the air pressure differential between the air chambers 58*a* and 58*b*.

It should be noted that the branch discharge tubes 70 are each positioned slightly inwardly of the upper end of the sloping side wall 62 so that grease impinging such side wall adjacent the tubes is not simply forced up the tubes by the exhausted air. This horizontally inward offsetting of the tubes 70, and thus the air streams within them, aids the "lip" portion of the upper end wall 60 in performing its grease-trapping function.

For the second additional stage of grease removal and separation, the rain hood 74 is employed. Referring again to FIG. 5, the exhaust air discharged upwardly through the tubes 70 (which are spaced horizontally outwardly of the hood discharge opening 80) impinges upon the inner surfaces of the upwardly sloping hood side walls 78 before this discharged air is deflected horizontally inwardly and then forced upwardly through the discharge opening 80. Residual grease in the air stream which impinges the side walls 78 is forced upwardly along their inner surfaces and is trapped by a grease lip 144 defined by a downward extension of the discharge opening flange 82.

This trapped grease, which is separated from the air stream discharged upwardly through the discharge opening 80, drips off the grease lip 144 and falls into the drain pan 84 below as indicated by dashed arrows in FIG. 5. From the drain pan 84, the grease, together with any rain water falling into the drain pan, then flows through the drain tube 86 into a grease interceptor or trap 146 (FIGS. 2 and 3) which is recessed upwardly into a corner of the rain hood and secured thereto. In this corner location, the grease trap does not obstruct the flow of makeup air into the fan unit 20.

The grease trap 146 comprises a rectangular housing 147 having an open upper end. A vertical baffle plate 148 is connected to and extends between an opposite pair of vertically extending side walls of the housing, dividing it into two chambers 150, 152. The bottom end of the baffle 148 is positioned slightly above the bottom wall of the trap housing 146, defining with the bottom wall a small gap through which the chambers 150, 152 communicate. Extending upwardly through the bottom wall of the housing 146 into the chamber 152, and having an open upper end positioned above the gap beneath the baffle, is a small drain tube 154.

The outer end of the drain pan drain tube 86 is turned down and is positioned directly above the trap chamber 150. Grease and/or water draining through the tube 86 thus fall into the trap chamber 150. The grease entering the chamber 150 floats on top of the water entering such chamber and is thus precluded from entering the chamber 152 by the baffle 148. However, the water in the chamber 150 flows through the gap beneath the baffle into the adjacent chamber 152 where it is drained via the tube 154 into a suitable container (not shown) on the roof. The grease trapped in chamber 150 may then be periodically removed from the trap 146.

Summary

The described fan unit 20, because of its compactness, low manufacturing and installation costs, and its novel integral grease-removing capabilities, is particularly well suited to the previously described cooking exhaust hood application. However, there are other ventilation applications, requiring the simultaneous supply and exhaust of air through a pair of concentric ducts, for which it is also well suited.

For example, the unit 20 may also be used as a room ventilation unit by connecting it to the concentric supply and exhaust ducts of a conventional combination supply and exhaust register mounted on the ceiling of the room or other area to be ventilated. Additionally, heating and/or cooling coils could be installed in the air discharge chamber 48 beneath the corner flow passages 68 to temper the incoming air if desired. The unit could thus be used with exhaust hoods not having the capability of the hood 10 to utilize untempered makeup air.

The described counterflow supply and exhaust air fan unit eliminates many, if not all, of the problems normally associated with conventional field-fabricated exhaust and makeup air systems for kitchen exhaust hoods. Since the unit may be entirely shop-fabricated, a substantial construction cost savings is realized. Additionally, little skill or on-site labor time is required to connect the unit to the hood's concentric supply and exhaust ducts. Access to all of the unit's components for cleaning and repair is accomplished quickly and easily with no complicated disassembly and reassembly.

Moreover, the unit's integral two-stage grease separation mechanism eliminates the spraying of grease onto the roof and its attendant safety hazards. The unique positioning of the air delivery components within the unit permits the single motor to be mounted within the unit (where the motor is protected from the weather) yet entirely out of the exhaust air stream. The motor and associated drive means are relatively immune to any fires which may occur in the exhaust passages and chambers.

Because of the dual adjustment capabilities of the driving pulley and the inlet vane damper, the volumes of the counterflowing exhaust and makeup air streams may be varied over a wide range—either together or relative to each other.

It is emphasized that there are no breaks or gaps in the exhaust ductwork system. Thus, fire and other dangers are reduced.

Because centrifugal rotors (not axial) are employed, there are relatively high static pressures generated to overcome the grease-filter and inlet-filter resistances present in grease hoods, etc.

The use of a plurality of tubes 70 and their spacing, both circumferentially and horizontally, accomplishes several things:

a. The tubes are spaced outwardly of and circumferentially around the periphery of impeller 88. This provides a plurality of "takeoff" points for this impeller, thus improving its air delivery potential.
b. The tubes are offset inwardly relative to outer peripheral edge of upper end wall 60—this forms the grease-trapping lip or lips within the inner casing.
c. Circumferential spacing of tubes 70 permits fresh air entering intake chamber 46 to enter inlet cone 108 around substantially its entire perimeter. This improves the performance of the upper impeller 102.
d. Tubes 70 are spaced horizontally outwardly of the rain hood discharge opening 80. This spacing prevents rain from entering the tubes when the unit is off. It also directs exhaust air upwardly from the tubes against sloping hood walls 78, so that grease in the discharged air can be trapped by grease lip 144.
e. The circumferential spacing of tubes allows placement of motor 120 in fresh air intake chamber 46, which is highly compact and also protects the motor.

The lower ends of tubes 71 may be extended downwardly below the wall, thus further trapping grease.

The foregoing detailed description is to be clearly understood as given by way of illustration and example only, the spirit and scope of this invention being limited solely by the appended claims.

I claim:

1. A counterflow supply and exhaust air fan unit comprising:

(a) a first air handling casing having a closed upper end, a lower end having a discharge opening therein, and a side inlet opening;
(b) a second air handling casing mounted within said first casing and defining, in cooperation with the interior surface of said first casing, a downwardly extending air passage substantially circumscribing said second casing and opening outwardly through said first casing discharge opening, said second casing having a downwardly facing intake opening;
(c) a plurality of mutually spaced means connected to said second casing for conducting air from the interior thereof upwardly through said upper end of said first casing;
(d) first fan means operable to flow air from a first source laterally inwardly through said first casing inlet opening, downwardly through a central portion of said first casing, laterally outwardly to said air passage circumscribing said second casing, and then downwardly through said air passage and outwardly through said first casing discharge opening;
(e) second fan means operable to flow air from a second source upwardly through said second casing intake opening, laterally outwardly within said second casing, and then upwardly through said plurality of air conducting means; and
(f) means for simultaneously operating said first fan means and said second fan means.

2. The fan unit of claim 1 wherein one of said casings has a rectangular horizontal cross-section, and the other of said casings has a circular horizontal cross-section, at least a portion of said second casing being in an inscribed relationship with said first casing.

3. The fan unit of claim 2 wherein said one of said casings having a circular horizontal cross-section is said second casing.

4. The fan unit of claim 2 wherein said second casing has a truncated conical shape having an upwardly facing base and a downwardly facing open end defining said intake opening of said second casing.

5. A rooftop dual fan apparatus for connection to the concentric inner exhaust and outer supply ducts extending upwardly from a makeup air type exhaust hood or the like, said apparatus comprising:

(a) a first casing having an upper end, an open lower end adpated for connection to the supply duct, horizontal baffle means having a central opening formed therethrough and dividing said first casing into an upper fresh air inlet chamber and a lower fresh air discharge chamber, and a fresh air intake opening communicating with said inlet chamber;
(b) a second casing mounted within said air discharge chamber and defining, in cooperation with the interior surface of said first casing, a vertically extending air passage which substantially horizontally circumscribes said second casing and opens outwardly through said open lower end of said first casing, said second casing having an upper end spaced from said baffle means, and a downwardly facing open inlet end adapted for connection to the exhaust duct;
(c) means connected to said upper end of said second casing and defining a plurality of upwardly extending branch air discharge passages for transferring air from the interior of said second casing outwardly through said upper end of said first casing;
(d) supply means, including first centrifugal fan impeller means positioned between said second casing and said baffle means, operable to flow fresh air inwardly through said fresh air intake opening, downwardly through said vertically extending air passage around said second casing, and then outwardly through said open lower end of said first casing;
(e) exhaust means, including second fan impeller means positioned within second casing, operable to flow exhaust air into said inlet end of said second casing and then upwardly through said branch air discharge passages; and
(f) means for simultaneously operating said supply means and said exhaust means.

6. The apparatus of claim 5 wherein said operating means include motor means mounted within said first casing but externally of said second casing and said discharge passage-defining means.

7. The apparatus of claim 6 wherein said motor means comprises a single motor mounted within said air intake chamber of said first casing.

8. The apparatus of claim 5 wherein said operating means include a vertically extending shaft rotatably mounted within said apparatus, and said first and second impeller means are mounted on said shaft for rotation therewith.

9. The apparatus of claim 8 wherein said first and second impeller means each comprise a centrifugal fan impeller wheel.

10. The apparatus of claim 9 wherein said operating means further include means for rotating said shaft in a predetermined rotational direction, and each of said fan impeller wheels is of the backwardly inclined blade type relative to said rotational direction.

11. The apparatus of claim 5 further comprising control means for adjusting the quantity of fresh air discharged from said apparatus and the quantity of exhaust air drawn into said apparatus.

12. The apparatus of claim 11 wherein said operating means include means for conjointly rotating said first and second fan impeller means, and said control means include means for adjusting the conjoint rotational speed of said first and second fan impeller means.

13. The apparatus of claim 12 wherein said control means further include means for adjusting said fresh air quantity relative to said exhaust air quantity.

14. The apparatus of claim 13 wherein said relative air quantity adjusting means include an adjustable inlet vane damper mounted on said first fan impeller means.

15. The combination with an exhaust hood adapted to be mounted over cooking appliances in a kitchen, said exhaust hood being of the type in which grease-laden fumes are exhausted upwardly from the hood to the ambient atmosphere and makeup air is supplied downwardly to the hood from the ambient atmosphere, of a double fan apparatus adapted to effect both said exhausting and said supplying, said double fan apparatus comprising:

(a) fan means having an upper impeller section and a lower impeller section mounted on shaft means,
each of said impeller sections being a centrifugal impeller, (b) means to pass grease-laden fumes upwardly, from an exhaust duct connected to said exhaust hood, to said lower impeller section, (c) conduit means, disposed radially-outwardly from said lower impeller section, to receive said fumes therefrom and conduct said fumes upwardly to the upper part of said double fan apparatus, and thence to the ambient atmosphere, (d) means to conduct makeup air generally horizontally from the ambient atmosphere to said upper impeller section and then to conduct said makeup air generally horizontally from said upper impeller section to peripheral regions of said double fan apparatus, and (e) means to conduit said makeup air downwardly from said peripheral regions to a supply duct connected to said exhaust hood,
said conduit means (c) comprising a plurality of separate conduits positioned outwardly of said fan means and spaced apart sufficiently far that makeup air may flow therearound to and from said upper impeller section as recited in clause (d).

16. A double fan apparatus for delivering air to a predetermined region and exhausting air therefrom, which comprises:

(a) fan means having an upper impeller section and a lower impeller section mounted on vertical shaft means,
each of said impeller sections being a centrifugal impeller, said shaft means being a single vertical shaft driven by motor means, and (b) means to define first and second counterflow air-flow paths one of which is to deliver air to said predetermined region and the other of which is to exhaust air therefrom,
said first air-flow path having a first portion which extends generally horizontally between the ambient atmosphere and said upper impeller section, a second portion which connects to said first portion and extends through said upper impeller section and then extends horizontally, and a third portion which connects to said second portion and extends vertically between said predetermined region and said second portion, said second air-flow path having a first portion which extends vertically between said predetermined region and said lower impeller section, a second portion which extends through said lower impeller section and then horizontally, and a third portion which extends vertically between said second portion and the ambient atmosphere,
said third portion of said second air-flow path comprising a plurality of separate ducts, both of said horizontally-extending parts of said first air-flow path extending around the exteriors of said ducts.

17. The combination with an exhaust hood adapted to be mounted over cooking appliances in a kitchen, said exhaust hood being of the type in which grease-laden fumes are exhausted upwardly from the hood to the ambient atmosphere and makeup air is supplied downwardly to the hood from the ambient atmosphere, of a double fan apparatus adapted to effect both said exhausting and said supplying, said double fan apparatus comprising:

(a) fan means having an upper impeller section and a lower impeller section mounted on shaft means, (b) means to pass grease-laden fumes upwardly, from an exhaust duct connected to said exhaust hood, to said lower impeller section, (c) conduit means, disposed radially-outwardly from said lower impeller section, to receive said fumes therefrom and conduct said fumes upwardly to the upper part of said double fan apparatus, and thence to the ambient atmosphere, (d) means to conduct makeup air generally horizontally from the ambient atmosphere to said upper impeller section and then to conduct said makeup air generally horizontally from said upper impeller section to peripheral regions of said double fan apparatus, said conduit means (c) comprising a plurality of separate conduits positioned outwardly of said fan means and spaced apart sufficiently far that makeup air may flow therearound to and from said upper impeller section as recited in clause (d), (e) means to conduct said makeup air downwardly from said peripheral regions to a supply duct connected to said exhaust hood, (f) a rain hood mounted at the upper end of said double fan apparatus, said rain hood having solid portions above said conduits and onto which residual grease deposits, said rain hood having an open portion radially-inwardly of said solid portions, said open portion being adapted to exhaust fumes from said conduits, (g) grease trap means provided on said rain hood to cause grease deposited on said hood to fall downwardly instead of blowing upwardly through said open portion, and (h) means provided beneath said open portion to receive grease which thus falls.

18. In combination with an exhaust hood adapted to pass grease-laden fumes upwardly from a cooking appliance, a combination exhaust fan and grease trap means for preventing grease from being deposited on the building roof on which said exhaust fan is located, said exhaust fan and grease trap means comprising:

(a) an impeller, (b) means to direct grease-laden fumes from said exhaust hood into said impeller and to cause said fumes to be thrown horizontally by said impeller, (c) means provided in the path of said horizontally-thrown fumes to collect grease therefrom, (d) conduit means to conduct fumes upwardly from the vicinity of said means (c), (e) means to prevent said collected grease from passing upwardly through said conduit means (d), said means (e) being lip means, (f) rain-hood means provided above said conduit means (d), said rain-hood means collecting, on the underside thereof, residual grease from fumes which pass upwardly through said conduit means (d), said rain-hood means having therein an opening offset from said conduit means and through which fumes are discharged to the ambient atmosphere, and (g) means to prevent the grease collected on said underside of said rain-hood means from passing through said opening, said conduit means (d) comprising a plurality of separate conduits spaced around said impeller, said pevention means (e) blocking flow of grease into the lower ends of said conduit means.

19. In combination with an exhaust hood adapted to pass grease-laden fumes upwardly from a cooking appliance, a combination exhaust fan and grease trap means for preventing grease from being deposited on the building roof on which said exhaust fan is located, said exhaust fan and grease trap means comprising:

(a) an impeller, (b) means to direct grease-laden fumes from said exhaust hood into said impeller and to cause said fumes to be thrown horizontally by said impeller, (c) means provided in the path of said horizontally-thrown fumes to collect grease therefrom, said means (b) being an upwardly-convergent inlet cone for said impeller, said means (c) being a downwardly-convergent cone, there being a gap provided between said inlet cone and said downwardly-convergent cone to permit collected grease to drain into said exhaust hood, (d) conduit means to conduct fumes upwardly from the vicinity of said means (c), (e) means to prevent said collected grease from passing upwardly through said conduit means (d), said means (e) being lip means, said conduit means (d) comprising a plurality of separate conduits spaced around said impeller, said prevention means (e) comprising said lip means blocking flow of grease into the lower ends of said conduit means, (f) rain-hood means provided above said conduit means (d), said rain-hood means collecting, on the underside thereof, residual grease from fumes which pass upwardly through said conduit means (d), said rain-hood means having therein an opening offset from said conduit means and through which fumes are discharged to the ambient atmosphere, and (g) means to prevent the grease collected on said underside of said rain-hood means from passing through said opening.

20. In combination with an exhaust hood adapted to pass grease-laden fumes upwardly from a cooking appliance, a combination exhaust fan and grease trap means for preventing grease from being deposited on the building roof on which said exhaust fan is located, said exhaust fan and grease trap means comprising:

(a) an impeller, (b) means to direct grease-laden fumes from said exhaust hood into said impeller and to cause said fumes to be thrown horizontally by said impeller, (c) means provided in the path of said horizontally-thrown fumes to collect grease therefrom, said means (b) being an upwardly-convergent inlet cone for said impeller, said means (c) being a downwardly-convergent cone, there being a gap provided between said inlet cone and said downwardly-convergent cone to permit collected grease to drain into said exhaust hood, (d) conduit means to conduct fumes upwardly from the vicinity of said means (c), and (e) means to prevent said collected grease from passing upwardly through said conduit means (d), said means (e) being lip means, said conduit means (d) comprising a plurality of separate conduits spaced around said impeller, said prevention means (e) comprising said lip means blocking flow of grease into the lower ends of said conduit means.

* * * * *